US009157442B2

(12) United States Patent
Liu

(10) Patent No.: US 9,157,442 B2
(45) Date of Patent: Oct. 13, 2015

(54) FAN WITH INTEGRATED VIBRATION ABSORBING STRUCTURE

(75) Inventor: Wen-Hao Liu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 400 days.

(21) Appl. No.: 13/473,612

(22) Filed: May 17, 2012

(65) Prior Publication Data

US 2013/0309064 A1 Nov. 21, 2013

(51) Int. Cl.

*F04D 29/66* (2006.01)
*F04D 19/00* (2006.01)
*F04D 25/06* (2006.01)

(52) U.S. Cl.

CPC ..... *F04D 19/00* (2013.01); *F04D 19/002* (2013.01); *F04D 19/007* (2013.01); *F04D 25/06* (2013.01); *F04D 29/66* (2013.01); *F04D 29/668* (2013.01); *F05B 2260/964* (2013.01)

(58) Field of Classification Search

CPC ..... F04D 19/002; F04D 19/007; F04D 29/66; F04D 29/661; F04D 29/668; F04D 19/00; F05B 2260/964

USPC ..... 415/119, 213.1, 214.1, 220, 223, 60, 415/66, 68

See application file for complete search history.

(56) References Cited

U.S. PATENT DOCUMENTS

| | | | | |
|---|---|---|---|---|
| 5,186,605 | A * | 2/1993 | Tracy | 415/213.1 |
| 2005/0106008 | A1* | 5/2005 | Park et al. | 415/119 |
| 2006/0039109 | A1* | 2/2006 | Lin | 361/695 |
| 2006/0133035 | A1* | 6/2006 | Ku et al. | 361/695 |
| 2006/0269406 | A1* | 11/2006 | Cho | 415/220 |
| 2007/0020120 | A1* | 1/2007 | Oh et al. | 417/363 |
| 2008/0252859 | A1* | 10/2008 | Nagahata et al. | 353/61 |
| 2008/0286100 | A1* | 11/2008 | Hu et al. | 415/214.1 |
| 2011/0158791 | A1* | 6/2011 | Li | 415/119 |
| 2012/0027579 | A1* | 2/2012 | Wu et al. | 415/213.1 |
| 2012/0275917 | A1* | 11/2012 | Liu | 415/213.1 |

* cited by examiner

*Primary Examiner* — Christopher Verdier

(74) *Attorney, Agent, or Firm* — C. G. Mersereau; Nikolai & Mersereau, P.A.

(57) ABSTRACT

A fan with integrated vibration absorbing structure includes a fan frame, a hub-blade assembly, and at least one vibration absorber. The fan frame includes a base and at least one side wall formed around the base, and the hub-blade assembly is arranged in the fan frame. The at least one vibration absorber is provided on the at least one side wall to project therefrom for absorbing vibration produced by the fan during the operation thereof. Therefore, with the vibration absorbers integrated into the fan frame, it is no longer necessary to provide any additional vibration-absorbing member while upgraded vibration-absorbing effect can be achieved. Meanwhile, the fan can be more conveniently mounted at reduced mounting cost.

4 Claims, 12 Drawing Sheets

FAN WITH INTEGRATED VIBRATION ABSORBING STRUCTURE

FIELD OF THE INVENTION

The present invention relates to a fan with integrated vibration absorbing structure, and more particularly to a fan with integrated vibration absorbing structure that does not require any additional external vibration absorbing member while provides upgraded vibration absorption effect and can be conveniently mounted at reduced mounting cost.

BACKGROUND OF THE INVENTION

Thanks to the progress and development in the information technological fields, electronic products with high performance, high frequency, high operating speed and slim profile have been constantly introduced into the market. However, the heat produced by these electronic products during the high-speed operation thereof also increases to threaten the reliability and service life of the electronic products. Therefore, it has become a very important issue as how to dissipate the heat produced by the operating electronic products.

Currently, the cooling fan is one of the common heat dissipating structures for use with the heat-producing electronic products. Most of the currently available electronic products are internally equipped with a cooling fan to remove the produced heat from the electronic products, so that the electronic products can always operate within a specific operating temperature range. Due to the constantly increased demands of the electronic products for heat dissipation, the demands for enhanced air volume of the cooling fan also correspondingly increase. The most direct way to increase the cooling fan's air volume is to increase the rotational speed thereof.

A fan tends to produce vibration during the operation thereof. Such vibration increases with the rotational speed of the fan and might cause resonance of the system using the fan to thereby adversely affect the structural safety of the system. The vibration also brings noise and reduces the system stability. When two or more fans are parallelly or serially connected together in an attempt of providing increased air volume, the vibration produced by these parallelly or serially connected fans during their operation is further increased. Please refer to FIGS. 1A and 1B. A prior art fan 11 usually requires at least one additionally externally provided vibration absorbing member 12 for attaching to between the fan 11 and an electronic device, to which the fan 11 is mounted, so that the vibration absorbing member 12 absorbs the vibration produced by the fan 11 during the operation thereof. The vibration absorbing member 12 is mainly attached to one side wall of a fan frame of the fan 11 to reduce the vibration against the electronic device. In the case of using two or more parallelly or serially connected fans 11 (not shown), the externally provided vibration absorbing member 12 is also frequently provided between two adjacent fans 11 for absorbing the vibration.

Generally, the currently available slim type electronic products all have very limited internal space, which causes limitation and inconvenience in mounting the vibration absorbing members 12 to between the fan 11 and the electronic product. Thus, the cost for mounting the fan 11 and the vibration absorbing members 12 will increase while the probability of defective mounting is high to adversely affect the effect of suppressing vibration.

In brief, the prior art fan has the following disadvantages: (1) requiring increased mounting cost; (2) tending to cause the problem of poor installation thereof; and (3) providing only limited effect in suppressing the vibration produced by the fan during the operation thereof.

SUMMARY OF THE INVENTION

A primary object of the present invention is to provide a fan with integrated vibration absorbing structure that does not require any additional external vibration absorbing member while provides upgraded vibration absorption effect.

Another object of the present invention is to provide a fan with integrated vibration absorbing structure that can be conveniently mounted at reduced mounting cost.

To achieve the above and other objects, the fan with integrated vibration absorbing structure according to the present invention includes a fan frame, a hub and blade assembly, and at least one vibration absorber. The fan frame has a base and at least one side wall, and a receiving space is defined on the fan frame at the base. The hub and blade assembly is arranged in the receiving space. The at least one vibration absorber is an elastic element provided on the at least one side wall to project therefrom. When the fan is mounted on an electronic device, the vibration absorber is in direct contact with a wall portion of the electronic device to directly absorb any vibration produced by the fan during the operation thereof. Therefore, with the vibration absorber integrated with the fan frame, it is no longer necessary to provide any additional external vibration absorbing member while upgraded vibration absorption effect can be obtained, and the fan can be more conveniently mounted to the electronic device at reduced mounting cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
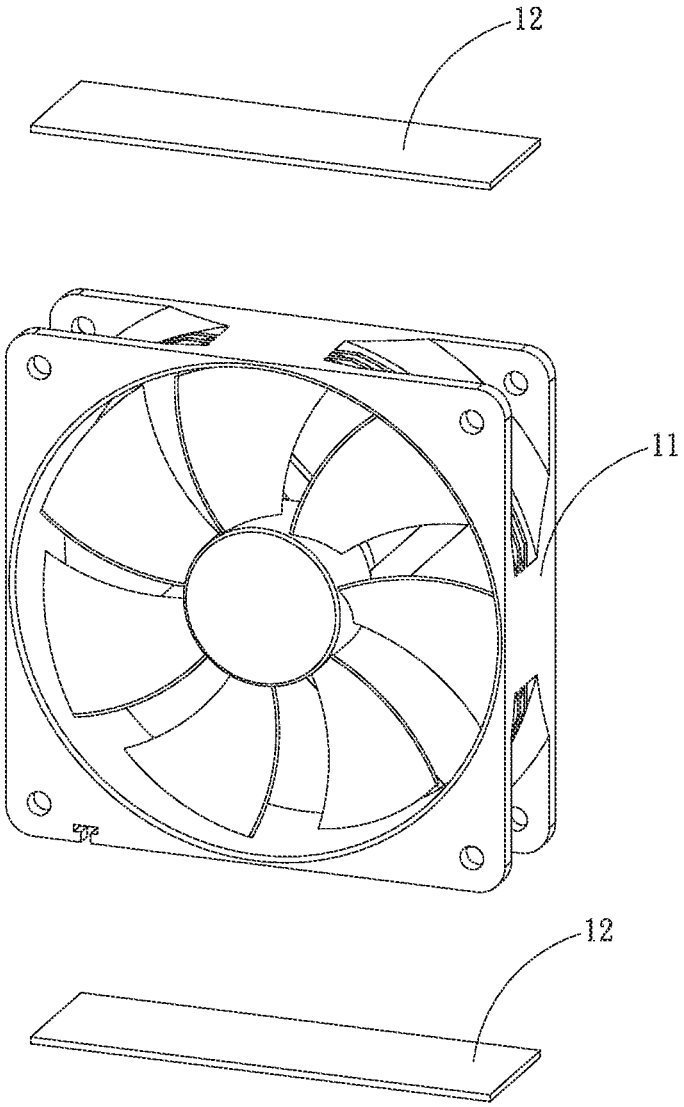
(PRIOR ART) Fig.1A
FIG. 1A is an exploded perspective view showing a fan with additionally attached vibration absorbing members according to prior art.
Figure 1B:
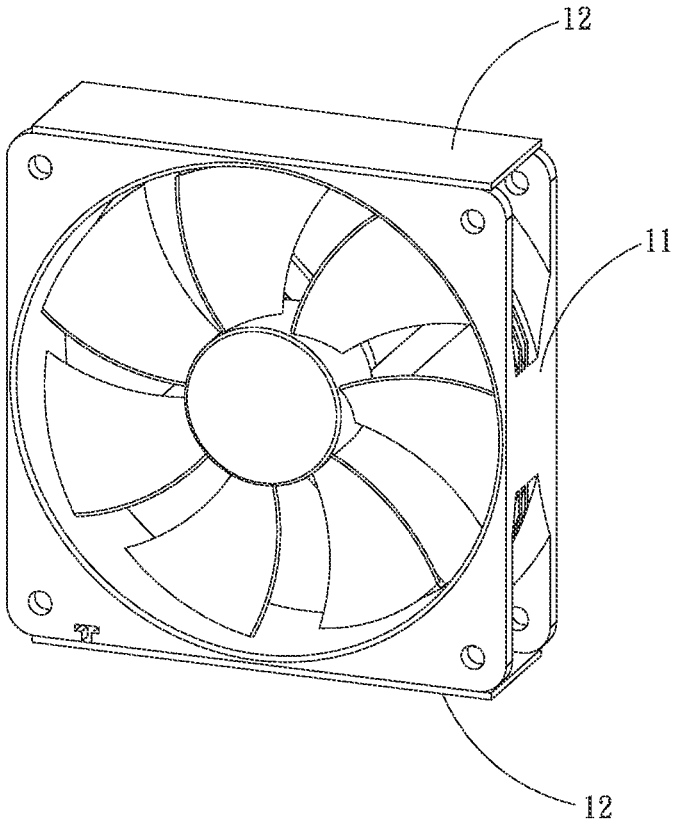
(PRIOR ART) Fig.1B
FIG. 1B is an assembled view of FIG. 1A.

The present invention will now be described with some preferred embodiments thereof and with reference to the accompanying drawings. For the purpose of being easy to understand, elements that are the same in the preferred embodiments are denoted by the same reference numerals.

Figure 2:
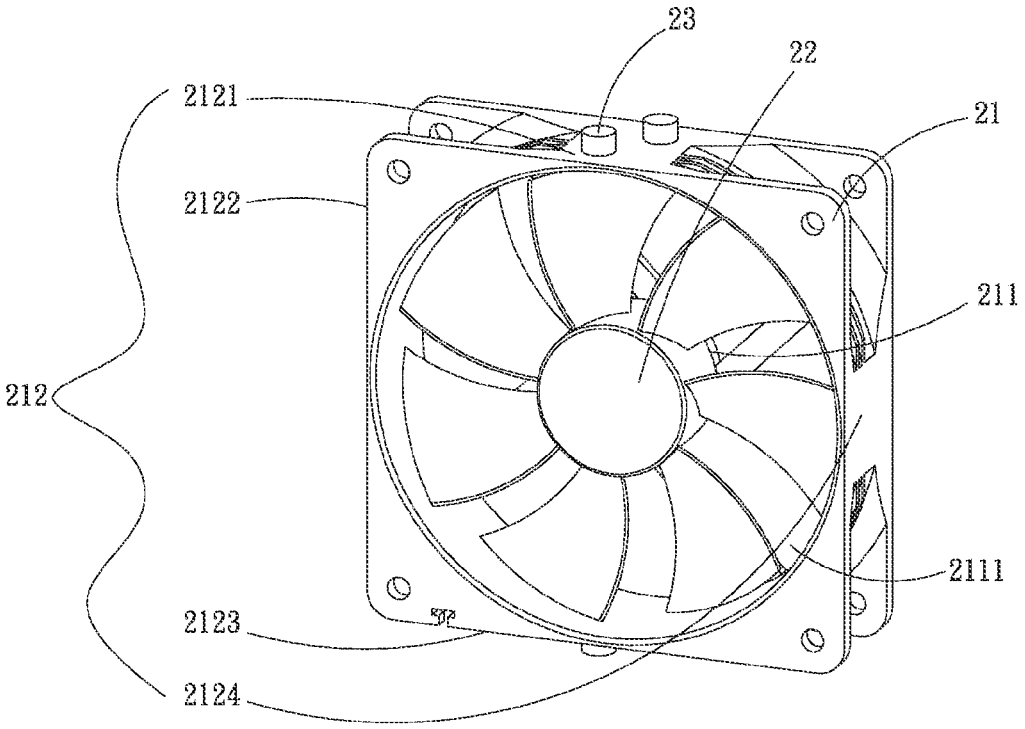
FIG. 2 is a perspective view of a fan with integrated vibration absorbing structure according to a first preferred embodiment of the present invention.

Please refer to FIG. 2 that is a perspective view of a fan with integrated vibration absorbing structure according to a first preferred embodiment of the present invention. As shown, the fan is generally denoted by reference numeral 2, and includes a fan frame 21, a hub and blade assembly 22, and at least one vibration absorber 23. The fan frame 21 includes a base 211 and at least one side wall 212 formed around the base 211. In the illustrated first preferred embodiment, there are four side walls 212, namely, a first side wall 2121, a second side wall 2122, a third side wall 2123, and a fourth side wall 2124. At the base 211 of the fan frame 21, there is defined a receiving space 2111, in which the hub and blade assembly 22 is arranged.

The vibration absorber 23 is provided on the side wall 212 to project in a direction away from the hub and blade assembly 22. The vibration absorber 23 can be assembled to the side wall 212 or be integrally formed on and projected from the side wall 212. Further, the vibration absorber 23 is an elastic element provided on one or more of the first, second, third and fourth side walls 2121, 2122, 2123, and 2124. In the illustrated first preferred embodiment, two vibration absorbers 23 are integrally formed on and projected from both the first and the third side wall 2121, 2123 without being limited thereto. That is, the vibration absorber 23 can be otherwise formed on only one side wall 212 or on two of the four side walls 212.

Figure 3:
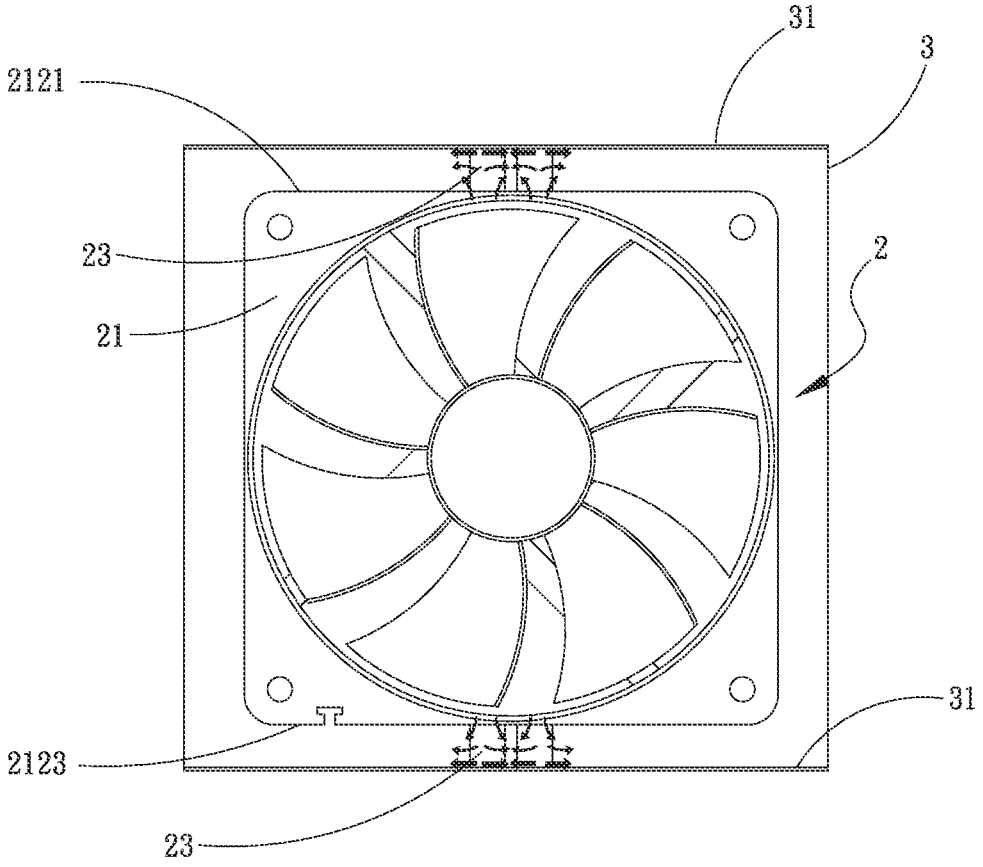
FIG. 3 shows the fan of FIG. 2 in use.

Please refer to FIG. 3 that shows the fan 2 according to the first preferred embodiment of the present invention in use. The fan 2 in use is mounted to a device 3. In the illustrated first preferred embodiment, the fan 2 is mounted to a wall portion 31 of the device 3 with the vibration absorbers 23 provided on the first and the third side wall 2121, 2123 of the fan 2 in direct contact with the wall portion 31. When the fan 2 operates and produces vibration against the wall portion 31 of the device 3, the produced vibration is directly absorbed by the vibration absorbers 23 projected from the fan frame 21. With the vibration absorbers 23 integrated into the fan frame 21, it is no longer necessary to provide any additional vibration-absorbing member while upgraded vibration-absorbing effect can be achieved. Meanwhile, the fan 2 can be more conveniently mounted to the device 3 at reduced mounting cost.

Figure 4A:
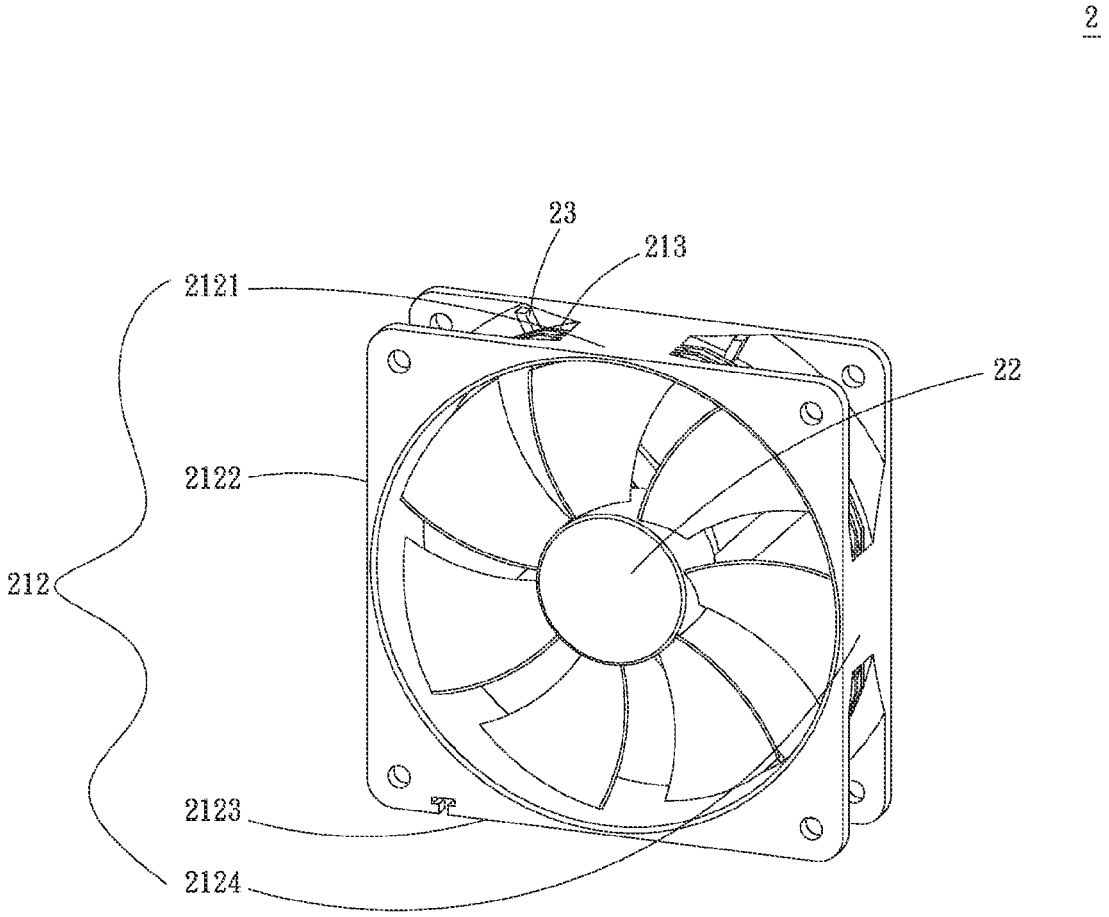
FIG. 4A is a perspective view of a fan with integrated vibration absorbing structure according to a second preferred embodiment of the present invention.
Figure 4B:
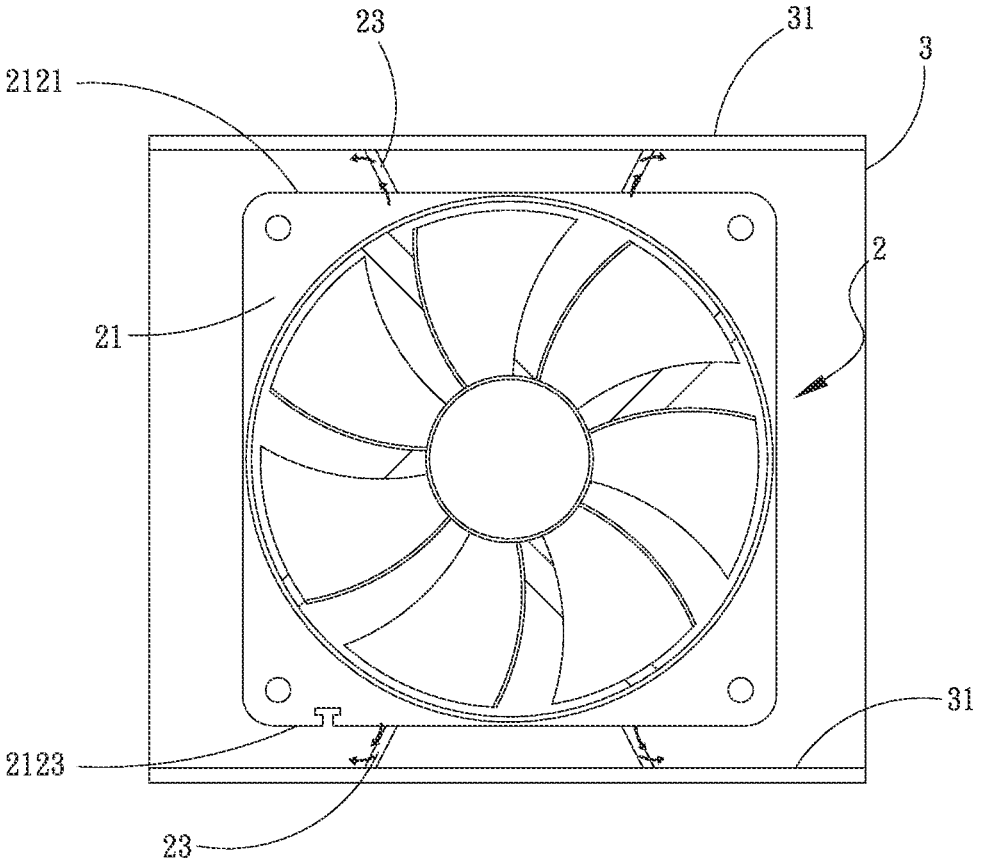
FIG. 4B shows the fan of FIG. 4A in use.
Figure 4C:
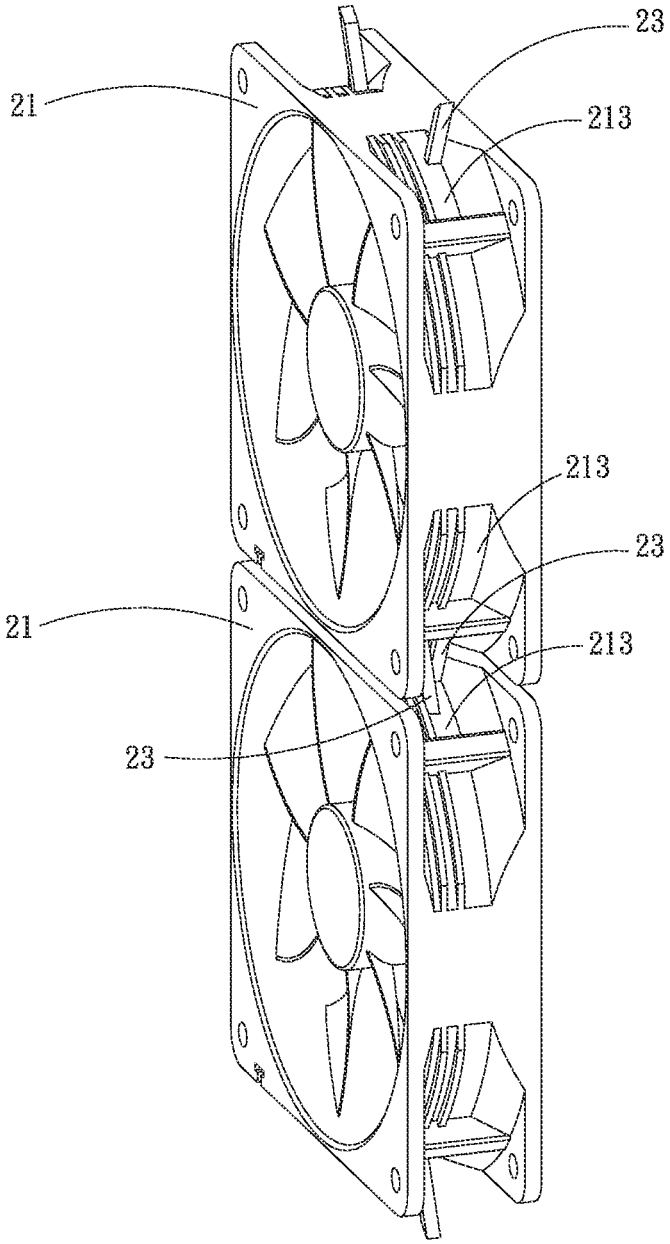
FIG. 4C shows two parallelly connected fans of FIG. 4A in use.

Please refer to FIGS. 4A, 4B and 4C, in which a fan with integrated vibration absorbing structure according to a second preferred embodiment of the present invention is shown. The fan 2 in the second preferred embodiment is generally structurally similar to that in the first preferred embodiment, except that the side walls 212 are provided with at least one recess 213, in which the vibration absorber 23 is arranged to outward project therefrom. In the illustrated second preferred embodiment, two recesses 213 are provided on both the first side wall 2121 and the third side wall 2123, and one vibration absorber 23 is provided in each of the recesses 213 to project in a direction away from the hub and blade assembly 22. When the fan 2 is mounted to the wall portion 31 of a device 3 and operates, any vibration produced by the fan 2 during the operation thereof is directly absorbed by the vibration absorbers 23, as shown in FIG. 4B. Alternatively, two fans 2 can be parallelly connected together, as shown in FIG. 4C. In this case, the vibration absorbers 23 extended from the fan frames 21 of the two fans 2 can directly absorb the vibration produced by the two fans 2 against each other during the operation thereof. Therefore, with the vibration absorbers 23 integrated into the fan frame 21, it is no longer necessary to provide any additional vibration-absorbing member while upgraded vibration-absorbing effect can be achieved. Meanwhile, the fan 2 can be more conveniently mounted to the device 3 at reduced mounting cost.

Figure 5A:
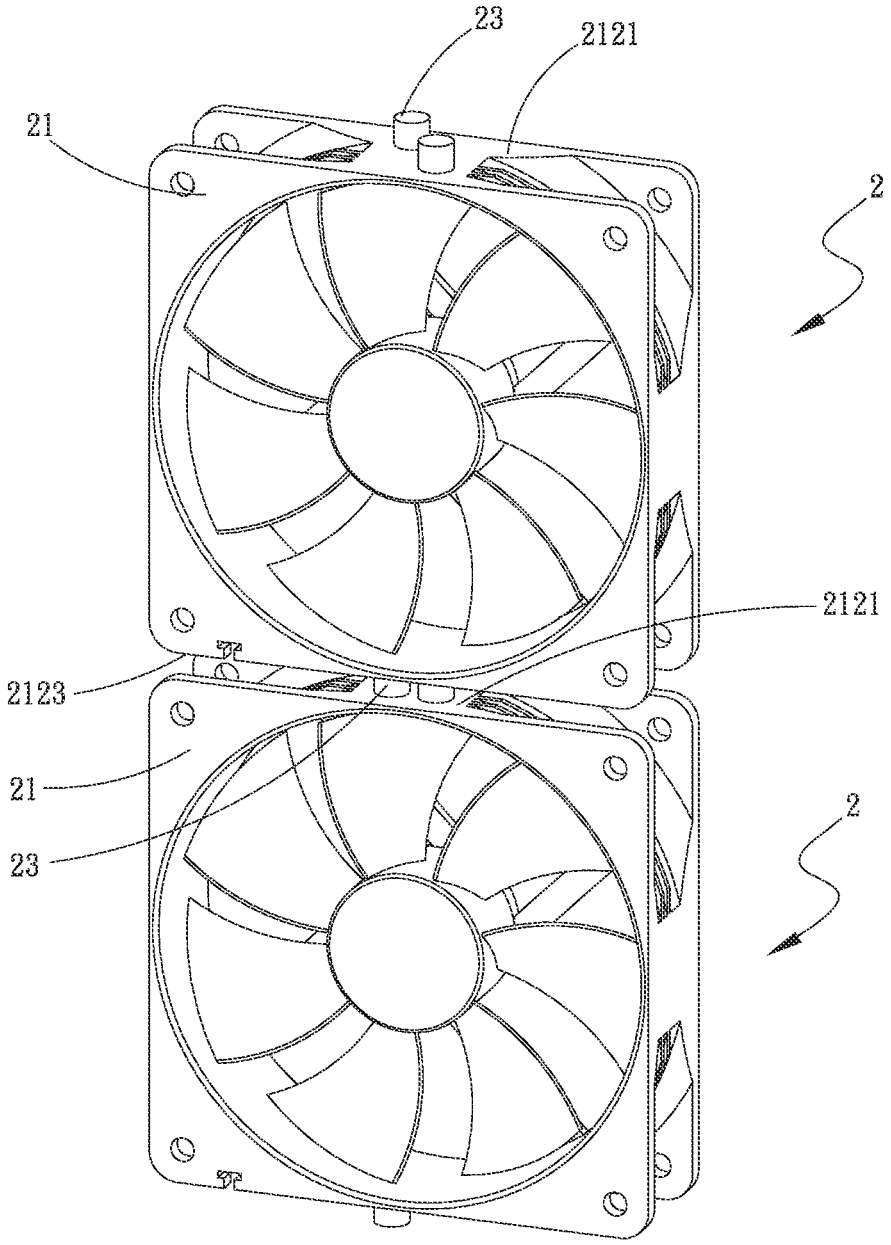
FIG. 5A is a perspective view of two parallelly connected fans with integrated vibration absorbing structure according to a third preferred embodiment of the present invention.
Figure 5B:
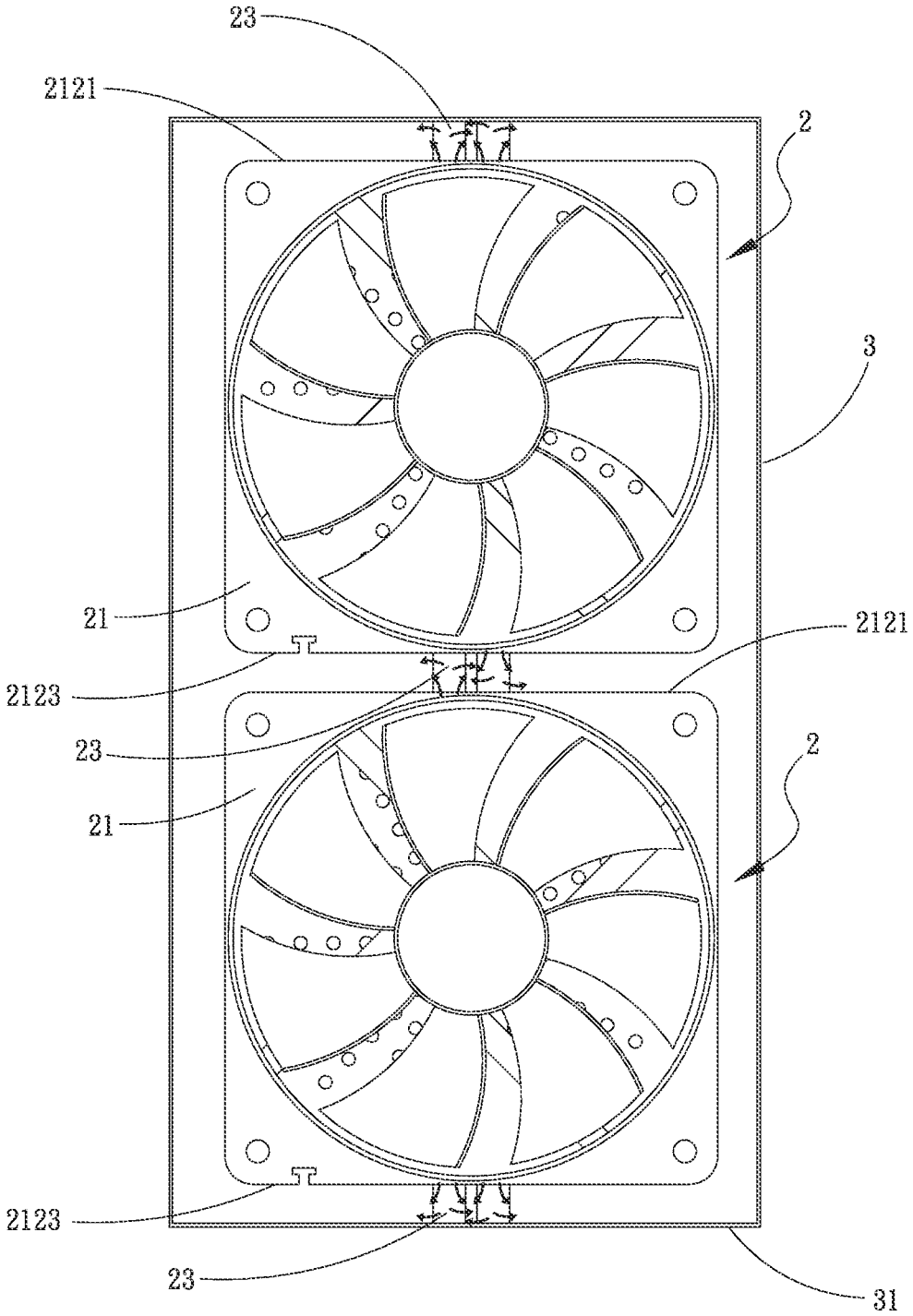
FIG. 5B shows the fans of FIG. 5A in use.

Please refer to FIGS. 5A and 5B, in which a fan with integrated vibration absorbing structure according to a third preferred embodiment of the present invention is shown. The fan 2 in the third preferred embodiment is generally structurally similar to that in the first preferred embodiment, except that the vibration absorbers 23 are provided only on the first side wall 2121 to project in a direction away from the hub and blade assembly 22. Again, two fans 2 can be parallelly connected together with the vibration absorbers 23 provided on the first side wall 2121 of one fan 2 in direct contact with the third side wall 2123 of the other fan 2. When the two parallelly connected fans 2 are mounted to the wall portion 31 of a device 3 and operate, vibration produced by the two fans during the operation thereof against each other and against the wall portion 31 can be directly absorbed by the vibration absorbers 23 projected from the fan frames 21. Therefore, with the vibration absorbers 23 integrated into the fan frame 21, it is no longer necessary to provide any additional vibration-absorbing member while upgraded vibration-absorbing effect can be achieved. Meanwhile, the fan 2 can be more conveniently mounted to the device 3 at reduced mounting cost.

Figure 6A:
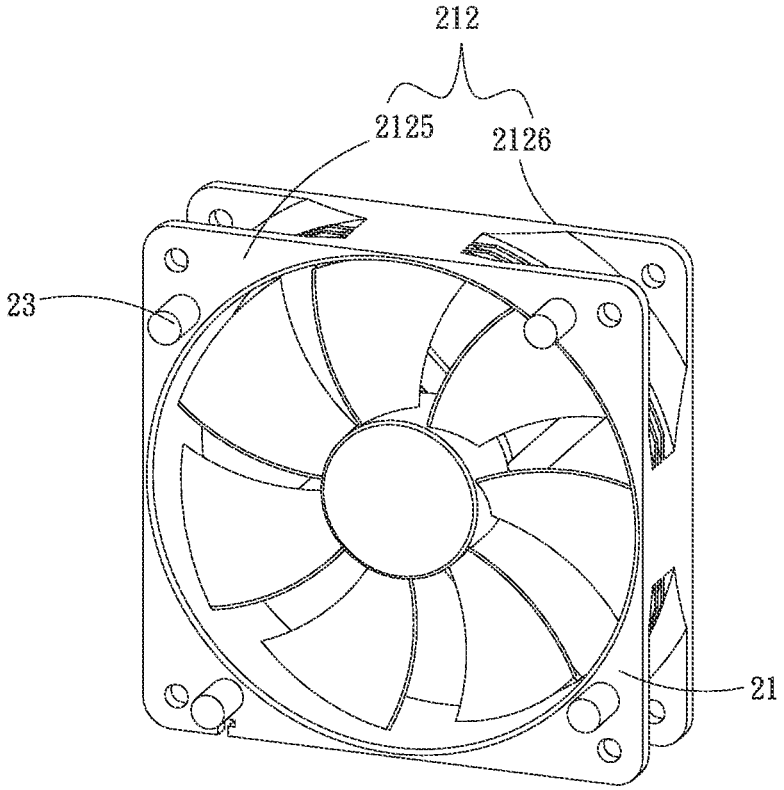
FIG. 6A is a perspective view of a fan with integrated vibration absorbing structure according to a fourth preferred embodiment of the present invention.
Figure 6B:
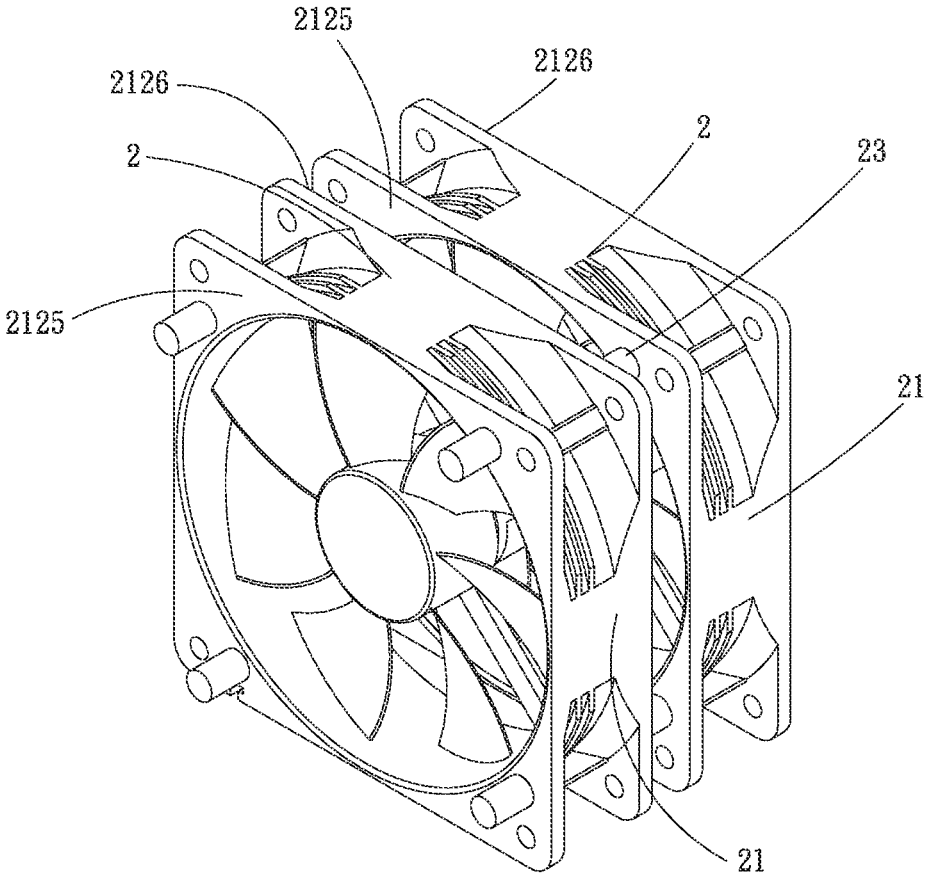
FIG. 6B shows two serially connected fans of FIG. 6A.
Figure 6C:
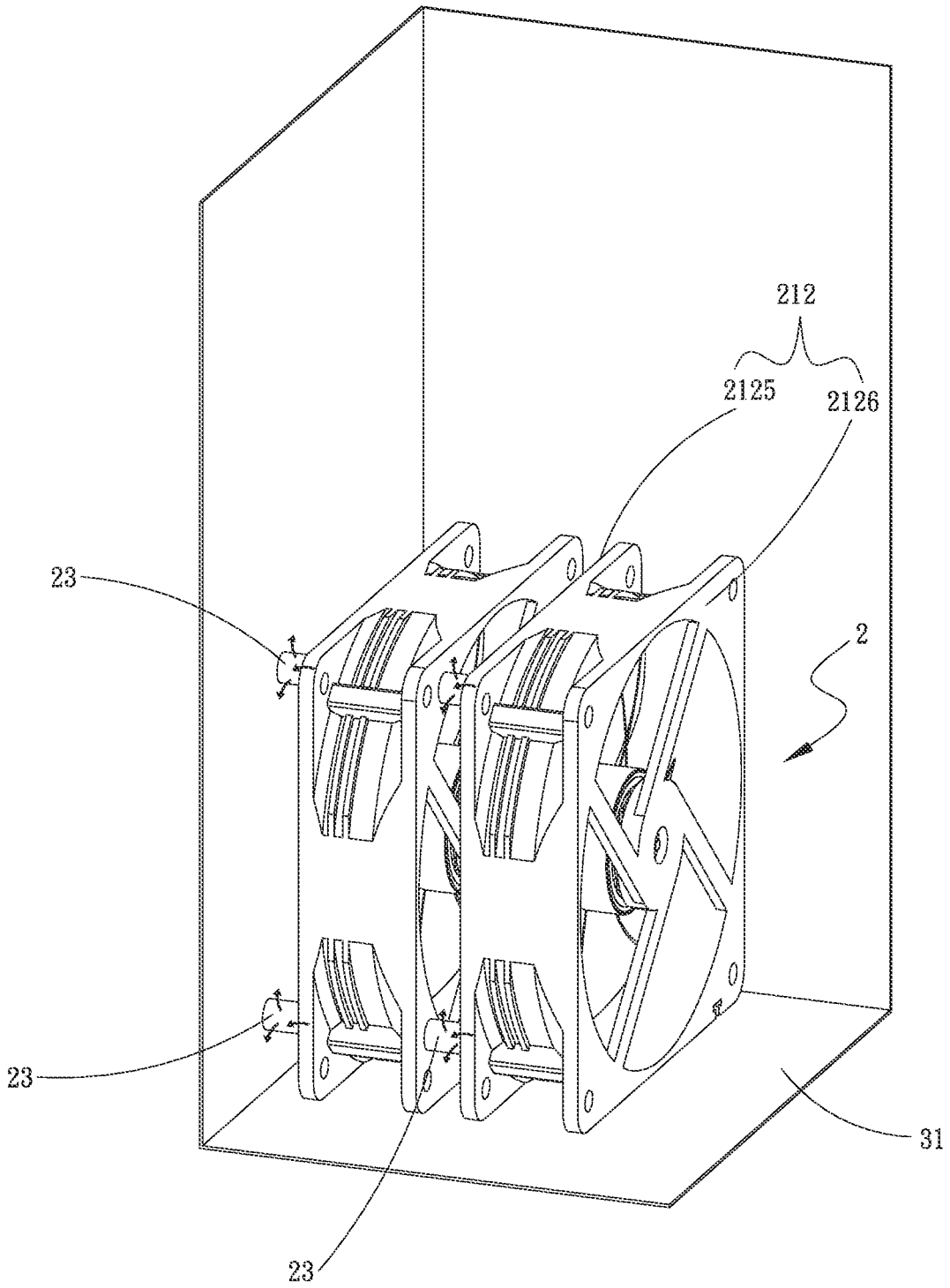
FIG. 6C shows the serially connected fans of FIG. 6B in use.

FIG. 6A shows a fan with integrated vibration absorbing structure according to a fourth preferred embodiment of the present invention. The fan 2 in the fourth preferred embodiment is generally structurally similar to that in the previous preferred embodiments, except that the at least one side wall 212 formed around the fan frame 21 includes an upper side wall 2125 and a lower side wall 2126, and the at least one vibration absorber 23 is provided on both the upper and the lower side wall 2125, 2126. In the illustrated fourth preferred embodiment, the vibration absorbers 23 are integrally formed on and projected from the upper side wall 2125 without being limited thereto. That is, the vibration absorbers 23 may be formed on only one or both of the two side walls 2125, 2126. Further, as shown in FIG. 6B, two fans 2 according to the fourth preferred embodiment can be serially connected together with the vibration absorbers 23 provided on the upper side wall 2125 of one fan 2 in direct contact with the lower side wall 2126 of the other fan 2. When the serially connected fans 2 are mounted to the wall portion 31 of a device 3, as shown in FIG. 6C, the vibration produced by the two fans 2 during the operation thereof against each other and against the wall portion 31 is directly absorbed by the vibration absorbers 23 projected from the fan frames 21. Therefore, with the vibration absorbers 23 integrated into the fan frame 21, it is no longer necessary to provide any additional vibration-absorbing member while upgraded vibration-absorbing effect can be achieved. Meanwhile, the fan 2 can be more conveniently mounted to the device 3 at reduced mounting cost.

In conclusion, the fan with integrated vibration absorbing structure according to the present invention has the following advantages: (1) no additional external vibration absorbing member is required; (2) reduces the mounting cost thereof; and (3) provides upgraded vibration absorbing effect.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan with integrated vibration absorbing structure, comprising:

a fan frame having a base and a first side wall, a second side wall, a third side wall, a fourth side wall formed around the base, and a receiving space being defined in the first, second, third, fourth, upper and lower walls; the base being disposed on the lower side wall;

a hub and blade assembly being arranged in the receiving space; and at least one solid vibration absorber being provided, that projects outward from said frame;

wherein at least one of the first, second, third and fourth side walls is provided with at least one curved recess outside the blade assembly between the upper wall and the lower wall; and wherein said at least one vibration absorber is arranged in said at least one recess to project outward radially from contact with an arcuate surface of said at least one recess in a direction away from the hub and blade assembly.

2. The fan with integrated vibration absorbing structure as claimed in claim 1, wherein the at least one vibration absorber is provided on one or two of the first, the second, the third and the fourth side wall.

3. The fan with integrated vibration absorbing structure as claimed in claim 1, wherein the at least one vibration absorber is provided on one or both of the upper and the lower side wall.

4. The fan with integrated vibration absorbing structure as claimed in claim 1, wherein the vibration absorber is an elastic element.

* * * * *